US008297943B2

(12) United States Patent
Shulver et al.

(10) Patent No.: US 8,297,943 B2
(45) Date of Patent: Oct. 30, 2012

(54) PUMP CONTROL USING OVERPRESSURE SOURCE

(75) Inventors: David R. Shulver, Ontario (CA); Matthew Williamson, Ontario (CA); Adrian C. Cioc, Ontario (CA)

(73) Assignee: Magna Powertrain, Inc., Concord (CA)

( * ) Notice: Subject to any disclaimer, the term of this patent is extended or adjusted under 35 U.S.C. 154(b) by 1105 days.

(21) Appl. No.: 11/935,646

(22) Filed: Nov. 6, 2007

(65) Prior Publication Data

US 2008/0107554 A1 May 8, 2008

(51) Int. Cl.
*F04B 49/00* (2006.01)

(52) U.S. Cl. ..... 417/310; 418/15; 418/27; 418/171; 137/529

(58) Field of Classification Search ..... 417/218, 417/219, 220, 221, 308, 310, 302; 418/166, 418/167, 171, 189, 201.2, 15, 27; 137/529
See application file for complete search history.

(56) References Cited

U.S. PATENT DOCUMENTS 2,493,929 A * 1/1950 Rittenhouse et al. ..... 137/434
2,586,147 A * 2/1952 Caserta ..... 137/536
2,904,973 A * 9/1959 Kosfeld ..... 62/324.6
5,722,815 A 3/1998 Cozens
5,752,815 A 5/1998 Muller
5,797,732 A 8/1998 Watanabe et al.
6,217,296 B1 4/2001 Miyazawa et al.
6,247,904 B1 6/2001 Miyazaki et al.
6,481,458 B2 11/2002 Hirano et al.
6,530,752 B2 3/2003 Oba et al.
6,616,419 B2 9/2003 Watanabe et al.
6,745,585 B2 * 6/2004 Kelm et al. ..... 62/236
6,804,970 B2 * 10/2004 Saeki et al. ..... 62/133
6,835,054 B2 * 12/2004 Morita ..... 418/15
7,794,217 B2 9/2010 Williamson et al.
8,118,575 B2 2/2012 Williamson et al.
2004/0144354 A1 7/2004 Staley et al.

* cited by examiner

*Primary Examiner* — Devon Kramer
*Assistant Examiner* — Dnyanesh Kasture
(74) *Attorney, Agent, or Firm* — Dobrusin & Thennisch PC

(57) ABSTRACT

A rotary positive displacement pump employs the higher pressure available at a region within the rotor chamber after the outlet port to augment the force of a biasing spring in a control system. A biasing spring with a lower spring force can thus be employed in the control system, resulting in a pump pressure output characteristic which can more closely match the operating speed varying working fluid requirements for devices supplied by the pump.

6 Claims, 7 Drawing Sheets

PUMP CONTROL USING OVERPRESSURE SOURCE

FIELD OF THE INVENTION

The present invention relates to rotary positive displacement pumps and the like. More specifically, the present invention relates to a system and method for controlling the output of rotary positive displacement pumps.

BACKGROUND OF THE INVENTION

Rotary positive displacement pumps, such as vane pumps or internal-external gear pumps are well known and are widely used in a variety of environments. As used herein, the term rotary positive displacement pump is intended to comprise vane pumps, gear and crescent pumps, internal-external gear pumps, etc. Further, internal-external gear pumps include pumps which have a rotor set that includes an outer rotor having a given number of lobes and an inner rotor with at least one less lobe. The inner rotor is driven and rotates within and with the outer rotor and the lobes of the inner rotor moving into and out of the lobes of the outer rotor form a series of pump chambers. Examples of internal-external gear pumps include gerotor pumps, trocoid pumps, duocentric pumps, hypocycloid pumps etc.

One common use for rotary positive displacement pumps is to supply and pressurize a working fluid, such as lubrication oil, for a prime mover device. For example, internal-external gear pumps are typically used to supply lubrication oil to internal combustion engines and the like.

In such uses, the oil pump is typically driven by the internal combustion engine and thus the operating speed of the oil pump changes with the engine operating speed and, as the operating speed of the pump changes, the output volume of the oil pump changes. The lubrication system of the engine can be viewed as a fixed size orifice, and thus changes in the output volume of the pump result in changes in the output pressure of the lubrication oil.

While the output pressure of the oil pump varies with the engine operating speed, at the same time, the lubrication oil pressure requirements of the internal combustion engine also vary with the operating speed of engine. However, the lubrication oil pressure requirements vary with the engine operating speed in a different manner than the output pressure of the oil pump varies with the operating speed of the engine and thus either a variable displacement pump, and suitable control, must be employed or a fixed displacement pump with a control mechanism is required to alter the output pressure of the oil pump to avoid undesired and/or unsafe operating conditions.

With fixed displacement pumps, the control mechanism employed is typically a form of pressure relief valve, where the valve has a spring biasing it to a first position wherein the full output of the pump is available to the engine. A control chamber is supplied with pressurized oil from the pump and this pressurized oil in the control chamber creates a force on the valve to move it against the biasing spring, from the first position, to a second position where some portion of the output of the pump is returned to a low pressure sink, such as the oil sump or the pump inlet.

Because the volumetric displacement of the oil pump must be sufficient to meet the engine lubrication requirements at relatively low pump operating speeds, generally the output of the oil pump is too high at higher operating speeds and the pressure relief valve allows some of the output of the pump to be returned to the low pressure sink.

While such fixed displacement pump systems are widely employed, they do suffer from some disadvantages. In particular, due to limitations in the operation of the pressure relief valve, the output of the pump exceeds the output required by the engine at many points of those expected operating conditions. When the pump output exceeds the engine operating requirements, engine energy is being wasted pressurizing lubrication oil which is not needed by the engine.

When a variable displacement pump is employed, such as a variable displacement vane pump, the pump includes a member or mechanism which is moved to alter the volumetric displacement of the pump as need. The control mechanism acts to move the member or mechanism as needed to alter the output of the pump. A variety of control mechanisms are known for variable displacement pumps, including: control pistons which are supplied with pressurized working fluid from the output of the pump and which act against a biasing spring; and single chamber or multi-chamber systems wherein pressurized working fluid from the output of the pump act directly on the control member or mechanism against the biasing force of a spring.

While variable displacement pumps tend to provide more energy efficient results, they also suffer from similar problems to those of fixed displacement pumps in meeting, but not exceeding, the pressure requirements of a prime mover which change with the operating speed of the prime mover and pump.

It is desired to have a rotary positive displacement pump with a control mechanism that provides for the output of the pump to more closely match the requirements of a prime mover device supplied with a working fluid, such as an internal combustion engine, at a reasonable cost.

SUMMARY OF THE INVENTION

It is an object of the present invention to provide a novel rotary positive displacement pump which obviates or mitigates at least one disadvantage of the present invention.

According to a first aspect of the present invention, there is provided a rotary positive displacement pump for supplying pressurized working fluid to a driving device, the pump comprising: a biasing spring acting against a force created by the pressurized working fluid from the outlet port of the pump to reduce the output pressure of the pump; and a region in the pump wherein the pressure of the working fluid is greater than the pressure of the working fluid at the outlet port of the pump, the greater pressure working fluid creating a force which augments the force of the biasing spring.

Preferably a pump body having a rotor chamber, a pump inlet communicating with an inlet port and a pump outlet communicating with the outlet port; a rotor set being rotatable in the rotor chamber to supply pressurized working fluid from the inlet port to the outlet port; and a control valve comprising: a piston moveable in a bore, the piston having a head and a shaft, the head of the piston being exposed to pressurized working fluid from the pump outlet which creates a force on the piston to urge the piston along the bore to a first position to expose a discharge port in fluid communication with a low pressure working fluid sink to permit pressurized working fluid to move to the low pressure working fluid sink to reduce the output pressure of the pump; the biasing spring acting against the shaft of the piston to bias the piston to a second position wherein the discharge port is blocked by the head of the piston to prevent pressurized working fluid to move to the low pressure working fluid sink; and a chamber located about the shaft of the piston adjacent the head, the chamber being in fluid communication with the higher pressure source of working fluid to receive pressurized working fluid therefrom to create a force on the piston to also bias the piston towards the second position.

Also preferably, the pump is a variable displacement vane pump with a control slide moveable to vary the displacement of the pump and wherein a control chamber is formed against the control slider and receives pressurized working fluid from the outlet of the pump, the pressurized working fluid creating a force to move the control slider to a position of reduced displacement, the biasing spring biasing the control slider toward a position of maximum displacement and a second chamber formed against the control slider receives pressurized working fluid from the region of higher pressure and creates a force on the control slider to augment the biasing force of the biasing spring.

The present invention provides a rotary positive displacement pump which employs a higher pressure source of working fluid to augment the force of a biasing spring in a control mechanism. A biasing spring with a lower spring force can thus be employed in the control mechanism, resulting in a pump pressure output characteristic which can more closely match the operating speed varying working fluid requirements for devices supplied by the pump.

BRIEF DESCRIPTION OF THE DRAWINGS

Preferred embodiments of the present invention will now be described, by way of example only, with reference to the attached Figures, wherein.

DETAILED DESCRIPTION OF THE INVENTION

Figure 1:
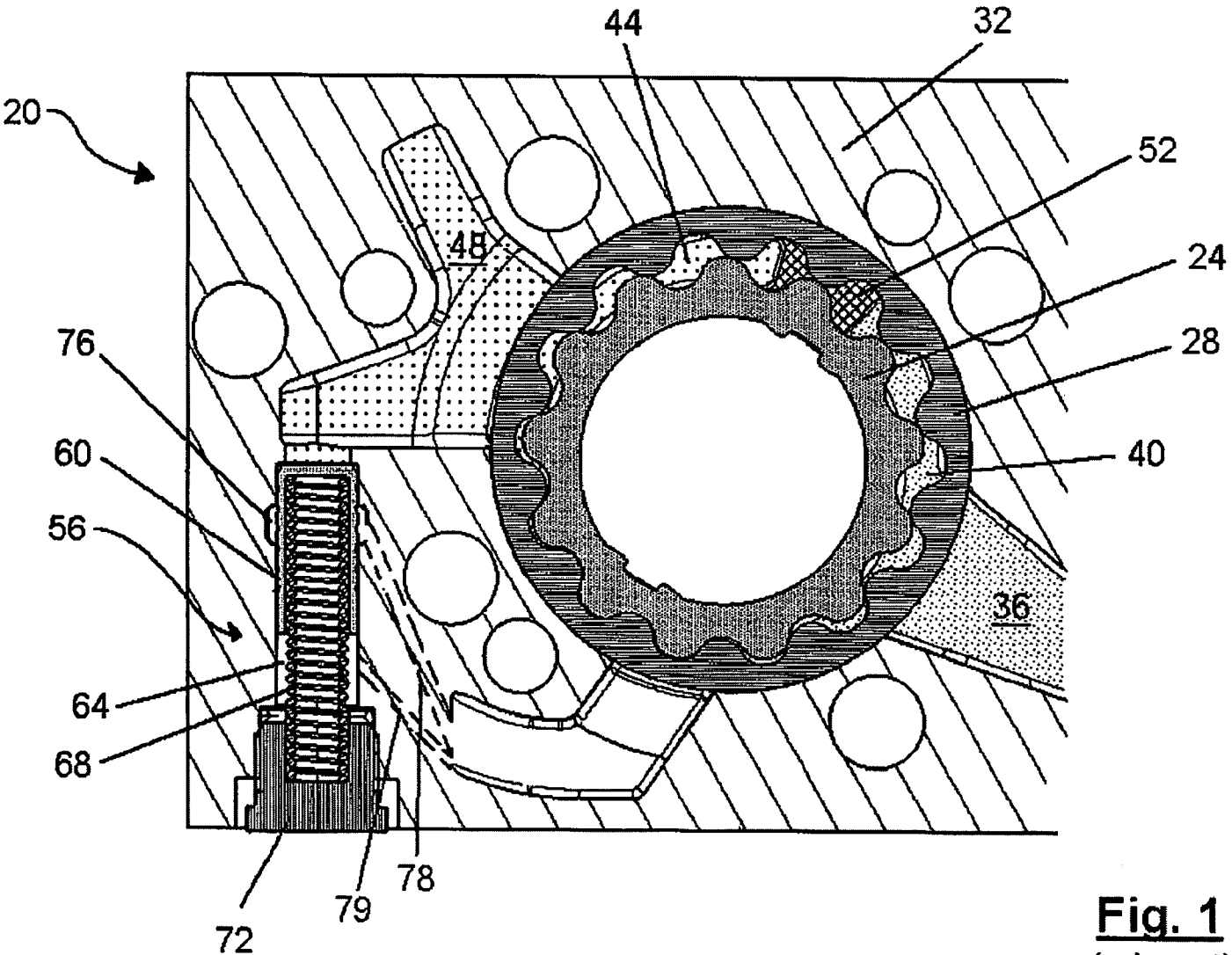
Fig. 1 (prior art)
FIG. 1 shows a section through a prior art rotary positive displacement pump.

Before describing the present invention, a prior art rotary positive displacement pump will first be described to assist in better understanding the present invention. Accordingly, a prior art internal-external gear pump is indicated at 20 in FIG. 1. Pump 20 includes a rotor comprising a driven inner rotor 24 and an outer rotor 28 which rotate within a rotor chamber in pump body 32.

Pump body 32 defines a pump inlet 36, which supplies unpressurized working fluid from a connected source of working fluid to be pressurized, to the pump chambers defined between the lobes of inner rotor 24 and outer rotor 28 through an inlet port 40.

The pressurized working fluid exits the pump chambers defined between the lobes of inner rotor 24 and outer rotor 28 via an outlet port 44, and exits pump 20 through a pump outlet 48.

Inlet port 40 and outlet port 48 are separated from each other by a pair of sealing lands 52 (only one of which is visible in FIG. 1) which inhibit leakage from the higher pressure side of pump 20 to the low pressure side of pump 20.

The output of pressure of pump 20 is controlled by a pressure relief valve 56. Valve 56 includes a control piston 60 which is moveable through a control bore 64. One end of control bore 64 is in fluid communication with pump outlet 48 such that pressurized working fluid in pump outlet 48 is introduced into control bore 64 and creates a force on control piston 60 to urge control piston 60 along control bore 64 away from pump outlet 48.

A biasing spring 68, acts against a valve plug 72 to bias control piston 60 along control bore 64 towards pump outlet 48. When the pressure of the working fluid in pump outlet 48, and hence in control bore 64, is high enough to produce sufficient force on control piston 60 to overcome the biasing force of biasing spring 68, control piston 60 is moved along control bore 64 away from pump outlet 48.

When control piston 60 moves far enough along control bore 64, a discharge port 76 is exposed to the pressurized working fluid in control bore 64 and the pressurized working fluid enters discharge port 76, where it is returned to a low pressure sink, such as pump inlet 36 or a sump, etc. by a return line 78 or other suitable means, reducing the pressure of the working fluid in pump outlet 48. The inside of bore 64 with biasing spring 68 is in fluid communication, via a passage 79, with pump inlet 36 to dampen movement of control piston 60 to reduce oscillations in the output pressure pump 20 and to mitigate or inhibit the occurrence of hydraulic lock.

By selecting the spring force of biasing spring 68 and the effective area of control piston 60 against which the pressurized working fluid acts, an equilibrium operating pressure can be achieved for pump 20.

While prior art rotary positive displacement pumps, such as pump 20, have been widely employed and work reasonably well, they suffer from a disadvantage in that the output characteristic of pump 20 tends to exceed the requirements of many driving devices, such as internal combustion engines, at a range of operating speeds.

Figure 2:
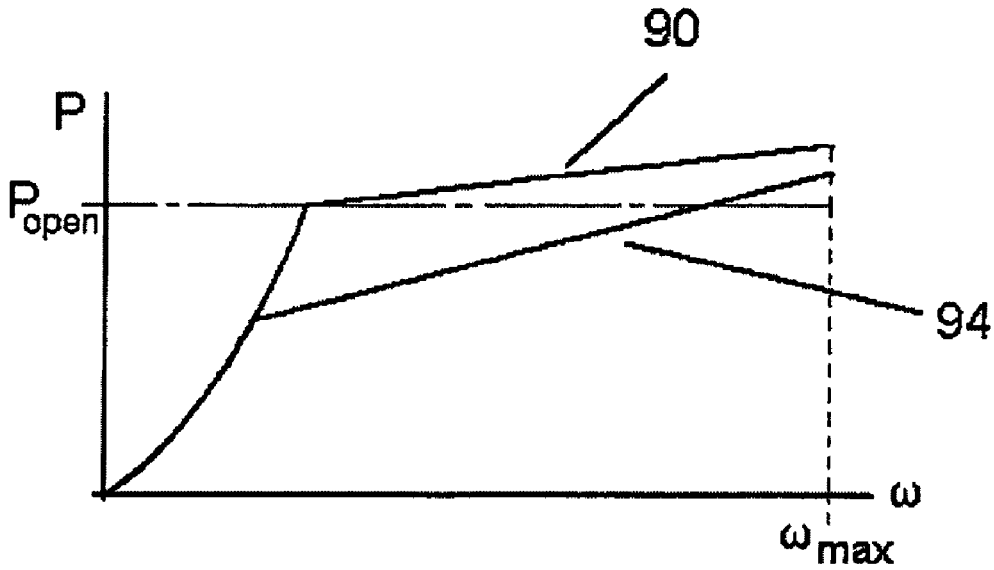
FIG. 2 shows a plot of the pump output characteristic of the prior art pump of FIG. 1.

FIG. 2 shows a plot of a typical output characteristic 90 of a rotary positive displacement pump such as pump 20 and a typical lubrication oil pressure requirement 94 for an internal combustion engine, where ω represents the operating speed of the driving device (and the pump) and $P_{open}$ represents the pressure at which control piston 60 is moved sufficiently to expose discharge port 76 to pressurized working fluid from pump outlet 48.

As can be seen, the pressure of the working fluid output from pump 20 significantly exceeds the requirements of the internal combustion engine over a large portion of the operating speed range and this oversupply of pressurized working fluid represents an energy loss to the internal combustion engine.

Figure 3:
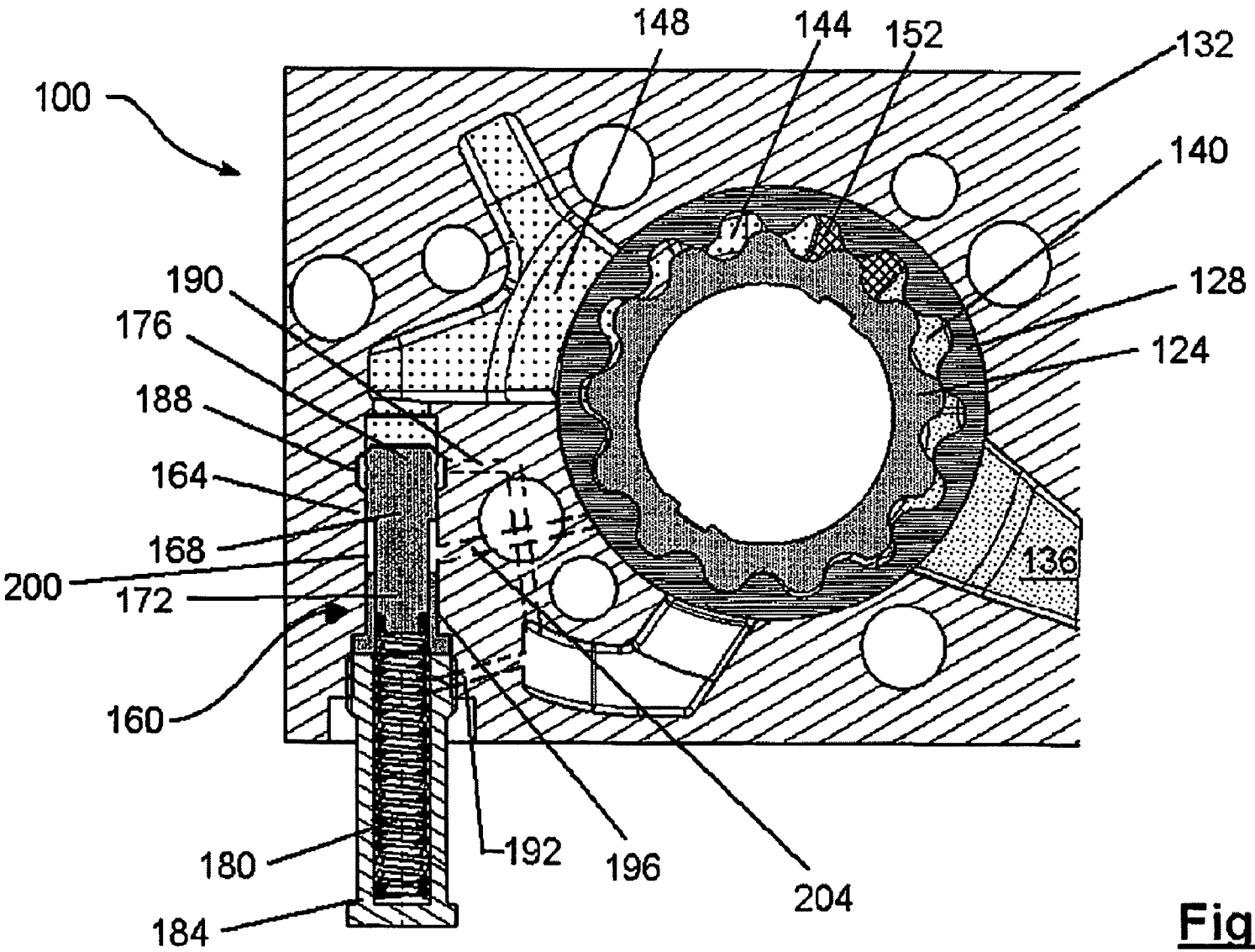
FIG. 3 shows a section trough an internal-external gear pump in accordance with the present invention.
Figure 4:
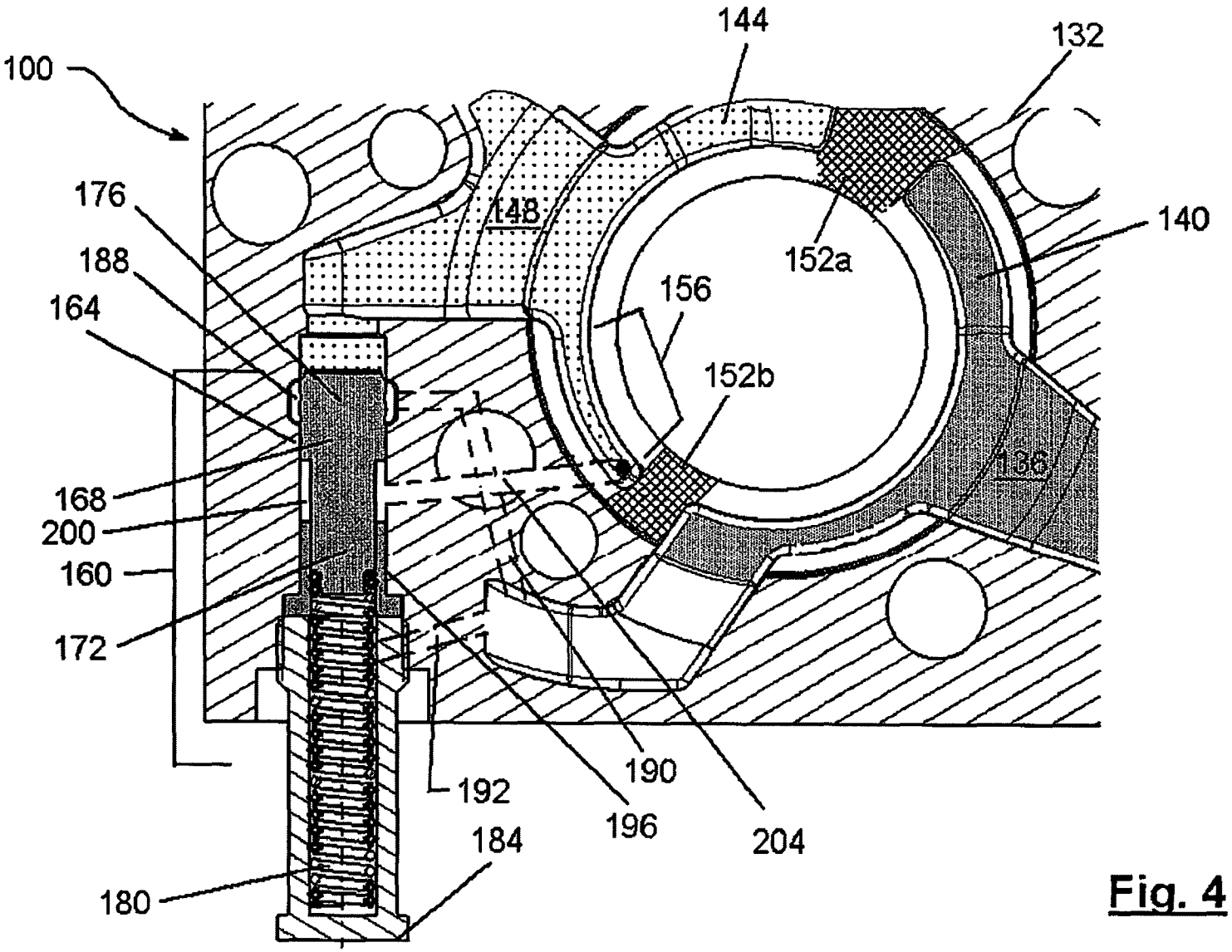
FIG. 4 shows the section of FIG. 3 with the inner and outer rotors of the pump removed.

In contrast, an embodiment of a rotary positive displacement pump in accordance with the present invention is indicated generally at 100 in FIGS. 3 and 4. In the illustrated embodiment, pump 100 is an internal-external gear pump similar to prior art pump 20.

Pump 100 includes a driven inner rotor 124 and an outer rotor 128 which rotate within a pump body 132. Pump body 132 defines a pump inlet 136 to the pump chambers defined between the lobes of inner rotor 124 and outer rotor 128 through an inlet port 140.

The pressurized working fluid exits the pump chambers defined between the lobes of inner rotor 124 and outer rotor 128 via an outlet port 144, and exits pump 100 through a pump outlet 148. Inlet port 140 and outlet port 148 are separated from each other by a pair of sealing lands 152*a*, 152*b* which inhibit leakage from the higher pressure side of pump 100 to the low pressure side of pump 100.

As can be seen in FIG. 4, pump 100 includes a region 156 wherein the working fluid is, during most operating conditions of pump 100, at a higher pressure than the pressurized working fluid at outlet port 144. Such higher pressure regions, wherein the working fluid is pressurized to a higher pressure than the working fluid at the outlet port, are common in many rotary positive displacement pumps. In region 156, the pump chambers formed between the lobes of inner rotor 124 and outer rotor 128 go to their minimum volume and yet (for packaging or other reasons) region 156 is located after outlet port 144. In the case of a vane pump embodiment of the present invention, region 156 results when the pump chambers, formed between the adjacent vanes and the rotor head, reach their minimum volume after the outlet port of the pump.

Thus, the working fluid still in the pump chambers of the fixed displacement pump after passing outlet port 144 is further pressurized compared to the working fluid at outlet port 144. Conventionally, a blind port, groove or passage, etc. is provided in region 156 to allow this higher pressure working fluid to be returned to outlet port 144, where it mixes with the lower pressure working fluid at outlet port 144.

The pressure of the working fluid at the end of region 156 distal outlet port 144 is, under most operating conditions and speeds of pump 100, at a higher pressure than the pressure of the working fluid at outlet port 144. As will be apparent to those of skill in the art, the actual pressure differential depends upon a variety of parameters including, the type of rotary positive displacement pump, the geometry, size and shape of region 156, the operating speed of pump 100, etc. but, for a given pump 100, the amount of the pressure differential is principally related to, and varies with, the operating speed of the pump 100.

In one specific embodiment of the present invention, when the pressure (P) of the working fluid at outlet port 144 is four bar (approx. 48 psi), the pressure of the working fluid at the end of region 156 (i.e. $-P_{BP}$) is as much as seven bar (approx. 101 psi) at the maximum operating speed of the pump.

Figure 5:
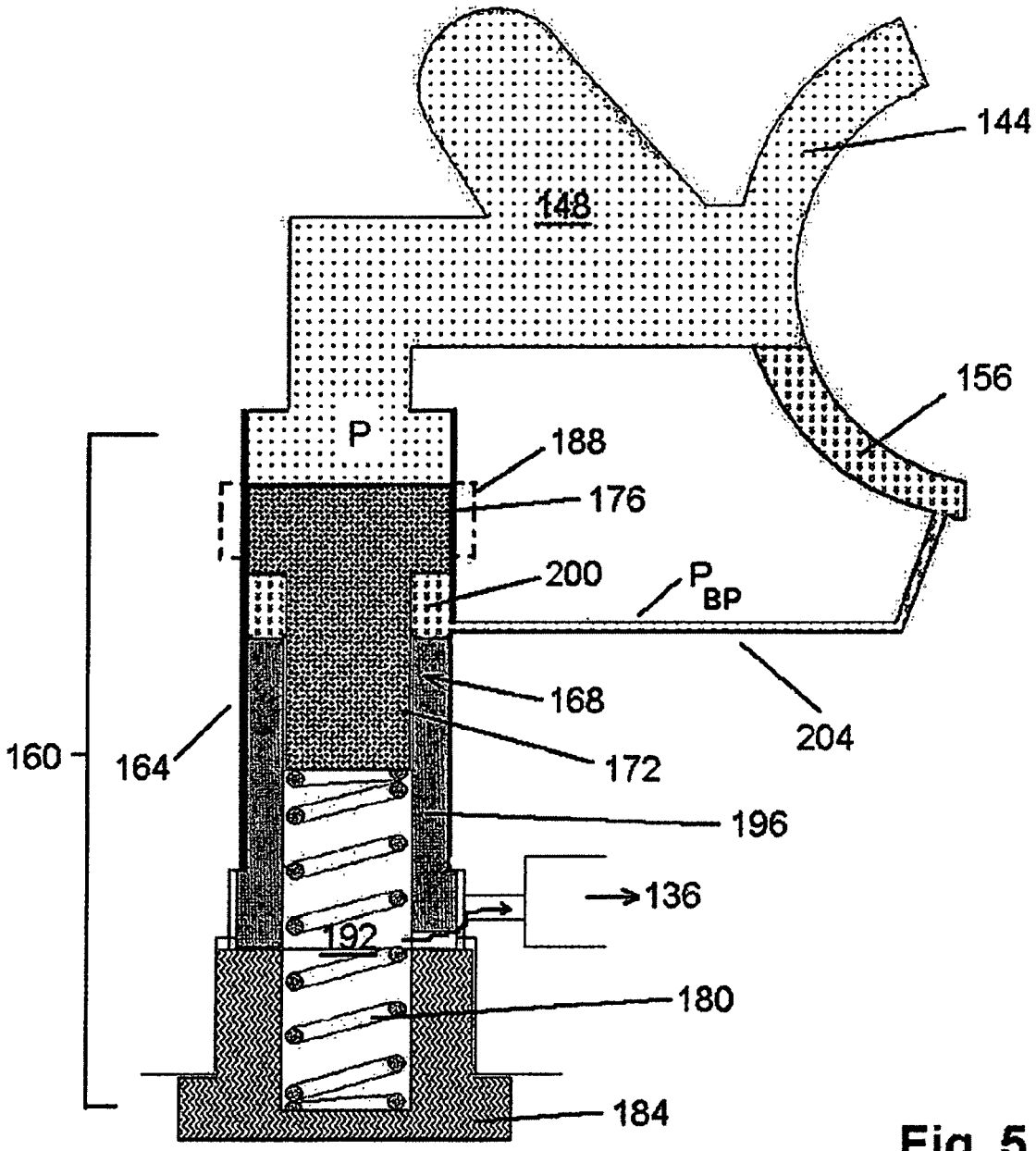
FIG. 5 shows a schematic representation of a portion of the pump of FIG. 3 showing more detail of a control valve.

Pump 100 includes a novel control valve 160. As seen in FIGS. 3, 4 and 5, valve 160 operates in a bore 164 in pump body 132 and includes a control piston 168 with a shaft 172 and a head 176. A biasing spring 180 acts against a valve plug 184 mounted to pump body 132 and urges piston 168 into bore 164 such that head 176 blocks a discharge port 188 which connects to a low pressure sink, such as pump inlet 136 or a working fluid sump, via a passage 190.

The side of head 176 opposite shaft 172 is exposed to pressurized working fluid from pump outlet 148 which is at pressure P and this pressurized working fluid creates a force on head 176 which acts against the force of biasing spring 180 to urge control piston 168 towards valve plug 184. When the force created on head 176 by pressure P is sufficient to move control piston 168 against he biasing force of biasing spring 180, head 176 will move past discharge port 188 allowing pressurized working fluid from pump outlet 148 to the low pressure sink through discharge port 188 and passage 190, reducing the output pressure of pump 100.

Pump 100 also includes a supply 192 of low pressure working fluid to pump inlet 136, or another suitable low pressure sink, to the inside of bore 164 with biasing spring 180 to dampen movement of control piston 168 to reduce oscillations in the output pressure P of pump 100 and to mitigate or inhibit the occurrence of hydraulic lock.

Control valve 160 further includes a control sleeve 196 which, with the side of head 176 adjacent biasing spring 180, forms a chamber 200 adjacent head 176. Chamber 200 is connected to region 156 by a gallery or bore 204, which supplies working fluid at pressure $P_{BP}$ to chamber 200.

As should now be apparent to those of skill in the art, the pressurized working fluid, at pressure $P_{BP}$, in chamber 200 creates a force on piston 168 which augments and combines with the force of biasing spring 180 on piston 168 to counter the force created by the pressurized working fluid, at pressure P, from pump outlet 148 acting on the opposite side of head 176. The pressure $P_{BP}$ increases with the operating speed of the pump, thus the degree of augmentation to the biasing force of biasing spring 180 increases with the operating speed of the pump.

With novel control valve 160, biasing spring 180 can be selected to have a reduced spring force, compared to a conventional pressure relief valve, as the working fluid from region 156, at pressure $P_{BP}$, will augment the biasing force of biasing spring 180. This, combined with the fact that $P_{BP}$ increases with the operating speed of the pump, allows the designer of the lubrication system for the prime mover device, such as an internal combustion engine, to achieve a pump output characteristic which is closer to the ideal characteristic for the prime mover device.

As will be apparent to those of skill in the art, by selecting the effective area of chamber 200, the spring force of biasing spring 180, the point at which gallery 204 connects to region 156 (as the pressure differential between P and $P_{BP}$ varies along the length of region 156) and the effective area of the side of head 176 opposite shaft 172, the designer of the lubrication system can achieve a variety of pump output characteristics.

The pressurization of working fluid to a higher pressure in region 156 is energy inefficient, as is known to those of skill in the art, and it is therefore generally desired to reduce the size of region 156 as much as possible. However, the present inventors have determined that control valve 160 requires very little flow of higher pressure working fluid to operate and thus region 156 can be very small, resulting in a further energy savings in the operation of pump 100, while still providing the benefits of the operation of control valve 160.

In tests of an embodiment of the present invention, outlet port 144 has been increased in size to reduce region 156 by as much as ninety percent from prior art designs, which has resulted in an energy savings of between five and twenty percent, depending upon the operating speed and conditions of pump 100, while still providing the advantageous operation of control valve 160.

Figure 6:
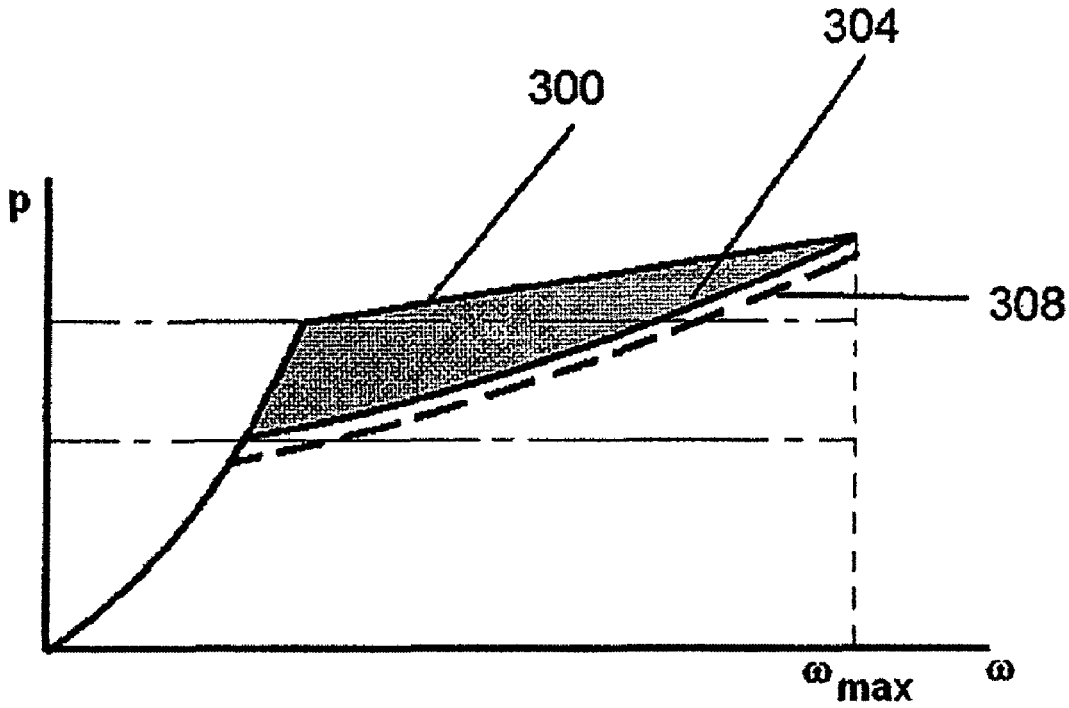
FIG. 6 shows plots of the operating speed versus the output pressure characteristic of the pump of FIG. 1, the output pressure characteristic of the pump of FIG. 3 and the working fluid requirements of a driving device.

FIG. 6 shows a graph of pressure P versus operating speed ω. In FIG. 6, plot 300 represents the output pressure characteristic of a prior art internal-external gear pump, such as pump 20, and plot 304 represents the output pressure characteristic of an internal-external gear pump in accordance with the present invention, such as pump 100. Plot 308 represents the working fluid requirements of a driving device, such as an internal combustion engine.

As can be seen, plot 304 more closely follows the working fluid requirements of the driving device and the shaded area between plots 300 and 304 represent the energy savings which can be obtained with the present invention compared to prior art pumps. In tests of a present embodiment of the invention, energy savings of five percent to twenty percent, depending upon the operating speed of the pump, compared to comparable prior art pumps, have been achieved.

Figure 7:
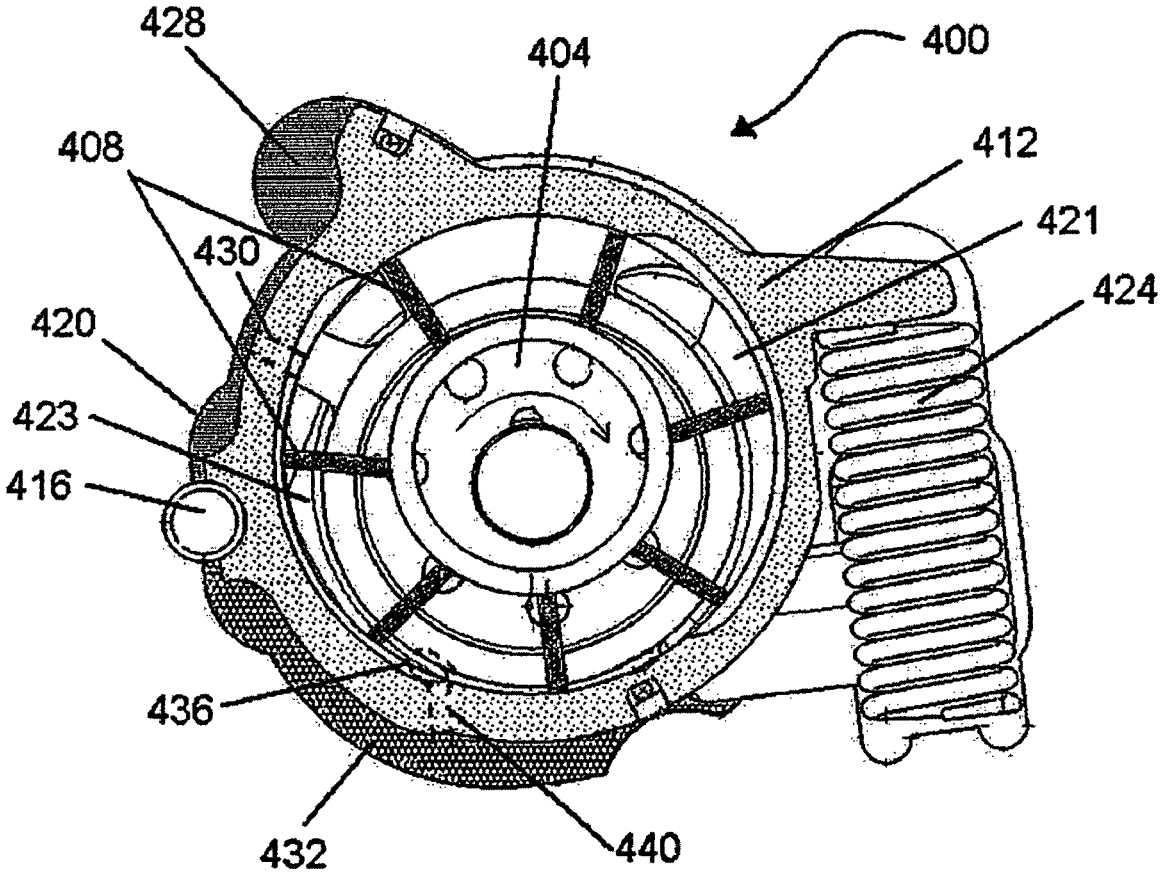
FIG. 7 shows a section through a variable displacement vane pump in accordance with the present invention.

FIG. 7 shows another embodiment of a rotary positive displacement pump 400 in accordance with the present invention. Pump 400 is a variable displacement vane pump which includes a rotor head 404 and a set of radially extending vanes 408. A pump control slide 412 encircles rotor head 404 and can be pivoted about a pivot pin 416 to after the eccentricity of rotor head 404 with respect to the rotor chamber in the body 420 of the pump to alter the displacement of pump 400.

Pump 400 includes an inlet port 421 and an outlet port 423 each of which is in fluid communication with a pump inlet and a pump outlet respectively. A biasing spring 424 biases control slide 412 towards the position of maximum eccentricity/maximum displacement. A control chamber 428 is formed between the outside of control slide 412 and pump body 420 and control chamber 428 is in fluid communication with the outlet port of pump 400 via a passage 430 such that pressurized working fluid is supplied to control chamber 428.

The pressurized working fluid in control chamber 428 creates a force on control slide 412 which acts against biasing spring 424 to move control slide 412 away from the maximum displacement position, thus reducing the volume, and hence pressure, of the working fluid output by pump 400. The use of biasing spring 424 and control chamber 428 to regulate the output pressure characteristic of variable displacement pumps is known.

However, pump 400 further includes a second control chamber 432 which is formed between pump body 420 and control slide 412 on the opposite side of pivot pin 416 to control chamber 428. Pump 400 includes a region 436, similar to region 156 of pump 100, where the working fluid is pressurized to a higher average pressure than the working fluid at outlet port 423 of pump 400.

Second control chamber 432 is in fluid communication with region 436 via a passage 440 such that this higher pressure working fluid creates a force on control slide 412 which augments the force of biasing spring 424 to move control slide 412 towards the maximum displacement position.

As was the case with pump 100, second control chamber 432 being supplied with higher pressure working fluid allows for the spring force of biasing spring 424 to be reduced, so that the output pressure characteristic of pump 400 can be more closely matched to the pressure characteristic required for operation of a prime mover, such as an internal combustion engine. Further, as once second control chamber 432 is flooded with pressurized working fluid only a small flow of pressurized working fluid is required from region 436, region 436 can be very small in size to reduce energy losses in pump 400.

The present invention provides a novel rotary positive displacement pump which employs the higher pressure available in a region of the rotor chamber after the outlet port to augment the force of a biasing spring used to control the output of the pump. A biasing spring with a lower spring force can thus be employed to control the pump, resulting in a pump pressure output characteristic which can more closely match the operating speed varying working fluid requirements for devices supplied by the pump.

The above-described embodiments of the invention are intended to be examples of the present invention and alterations and modifications may be effected thereto, by those of skill in the art, without departing from the scope of the invention which is defined solely by the claims appended hereto.

We claim:

1. A rotary positive displacement pump for supplying pressurized working fluid to a driving device, the pump comprising:

a control valve comprising a piston moveable in a bore and a biasing spring for biasing the piston to act against a force created by pressurized working fluid from a first outlet port of the pump to reduce output pressure of the pump; and a second outlet port wherein a pressure of the working fluid exiting the second outlet port is greater than a pressure of the working fluid at the first outlet port of the pump and varies with the speed of the pump, the greater pressure working fluid exiting the second outlet port is supplied to the control valve, creating a force which augments and combines with a force of the biasing spring acting on the control valve to counter the force of the pressurized working fluid from the first outlet port acting on the piston, and wherein the entire working fluid output of the second outlet port is supplied to the control valve.

2. The rotary positive displacement pump according to claim 1, further comprising:

a pump body having a rotor chamber, a pump inlet communicating with an inlet port and a pump outlet communicating with the first outlet port;

a rotor set being rotatable in the rotor chamber to supply working fluid from the inlet port to the first and second outlet ports; and wherein the piston is moveable in the bore, the piston having a head and a shaft, the head of the piston being exposed to pressurized working fluid from the first outlet port to urge the piston along the bore toward a first position to expose a discharge port in fluid communication with a low pressure working fluid sink which permits pressurized working fluid from the first outlet port of the pump to move to the low pressure working fluid sink and reduces pressure of the working fluid at the first outlet of the pump;

wherein the biasing spring biases the piston toward a second position wherein the discharge port is blocked by the piston which prevents pressurized working fluid from the first outlet port from moving to the low pressure working fluid sink;

and wherein the bore includes a chamber in which the shaft is located, the chamber in which the shaft is located being in fluid communication with the second outlet port of the pump to receive the pressurized working fluid from the second outlet port a thereby creating the augmenting force on the piston that additionally biases the piston toward the second position.

3. The rotary positive displacement pump of claim 2 wherein the pump is an internal-external gear pump and the rotor set comprises an inner rotor and an outer rotor which rotate within the rotor chamber.

4. The rotary positive displacement pump of claim 1 wherein the pump is a vane pump and the rotor set comprises a rotor head and a set of vanes extending radially from the rotor head.

5. The rotary positive displacement pump of claim 4 wherein the vane pump is a variable displacement vane pump with a control slide moveable to vary the displacement of the pump and wherein a control chamber is formed against the control slide and receives pressurized working fluid from the first outlet port of the pump, the pressurized working fluid from the first outlet port creating a force to move the control slide to a position of reduced displacement, the biasing spring biasing the control slide toward a position of maximum displacement and another chamber formed against the control slide receives pressurized working fluid from the second outlet port and creates a force on the control slide that augments the force of the biasing spring.

6. The rotary, positive displacement pump of claim 1 wherein the control valve further comprises a control sleeve movable to vary the displacement of the pump and further defining the bore around the piston.

* * * * *